United States Patent [19]

Willis

[11] 4,278,180

[45] Jul. 14, 1981

[54] CONTAINER CLOSURE WITH BREAKABLE ANNULAR RING

[75] Inventor: Wilburn C. Willis, Hagerstown, Ind.

[73] Assignee: Aluminum Company of America, Pittsburgh, Pa.

[21] Appl. No.: 115,027

[22] Filed: Jan. 24, 1980

[51] Int. Cl.[3] ..... B65D 41/34

[52] U.S. Cl. ..... 215/252

[58] Field of Search ..... 215/252, 250

[56] References Cited

U.S. PATENT DOCUMENTS

| | | | |
|---|---|---|---|
| 3,407,976 | 10/1968 | Homma | 215/250 X |
| 3,463,341 | 8/1969 | Fields | 215/252 |
| 3,504,818 | 4/1970 | Crisci | 215/252 |
| 3,861,551 | 1/1975 | Hannon | 215/252 |
| 4,126,240 | 11/1978 | Brach | 215/252 |

*Primary Examiner*—Donald F. Norton

*Attorney, Agent, or Firm*—Glenn E. Klepac

[57] ABSTRACT

A container closure comprising a cap and an annular ring connected to the cap by a bridge. The annular ring includes a laterally extending span or weakened portion having lesser tensile strength than the remainder of the ring. When the cap is rotated to loosen the cap, the annular ring is constricted radially inwardly, thereby abutting the container neck and frustrating removal until either the bridge or span is broken. A broken bridge or span indicates both visually and by touch that the closure has been tampered with. In a preferred embodiment, the cap and annular ring are integrally molded from plastic as a unitary structure.

11 Claims, 9 Drawing Figures

CONTAINER CLOSURE WITH BREAKABLE ANNULAR RING

BACKGROUND OF THE INVENTION

The present invention relates to container closures having features for providing evidence of tampering with the closure mechanism after such tampering has occurred.

Numerous tamper-evident closures for containers have been developed in the prior art. However, each of these prior art closures suffered from one or more serious disadvantages making it less than entirely suitable for its intended purpose.

For example, one such prior art closure is applicable only to containers having radially outwardly projecting tongues adapted to extend into gaps between webs in the closure. The container, therefore, is increased in cost, and the closure must be manufactured to close tolerances. Other prior art structures similarly are unduly structurally complex or require special fittings on the containers to which they are applied, thereby greatly increasing the expense of manufacture.

Another disadvantageous structure common to several prior art closures includes a ring or seal which is broken away from the closure cap by rotating the cap in the direction of opening. The inner surface of the ring is formed with pawls adapted to mesh with teeth integrally molded onto an exterior surface of the container. Either the pawls or the ring must flex radially outwardly to prevent slippage of the pawls past the teeth when the closure is rotated in the direction of closing. Such flexure often results in a wearing away of the pawls or teeth, thereby permitting the cap to be turned in the direction of opening without breaking the ring.

Yet another mechanism found in many prior art closures is a pull tab attached to a tamper-proof ring for severing the ring away from the main body of the closure. This pull tab mechanism may be accidentally triggered during rough handling of the container and is relatively expensive to manufacture.

A further disadvantage of some other prior art closures is that they include a metal cap and ring combination fastened onto the neck of a glass bottle. After the cap is removed, the metal ring remains attached to the bottle neck, thereby making it difficult to recycle the glass bottle.

SUMMARY OF THE INVENTION

It is a principal object of the present invention to provide a tamper-evident container closure that is simple in structure, inexpensive to manufacture and yet applicable to a wide variety of containers.

It is a further object of the invention to avoid the above-described difficulties encountered with several prior art tamper-proof closures.

An important advantage of the present invention is that there is provided a tamper-evident container closure which can be manufactured from plastic as an integrally molded, one-piece structure.

The foregoing objects and advantages are accomplished according to the present invention by providing a container closure comprising a cap and an annular ring connected to the cap by at least one bridge. The closure and container neck combine to constitute a one-way clutch mechanism wherein the annular ring is constricted radially inwardly to engage the neck upon application of torque to the cap in a loosening direction.

Removal of the closure from the container is frustrated until sufficient torque is applied to break a closure portion having diminished tensile strength.

In a preferred closure, the bridge extends vertically between the cap and annular ring. The annular ring includes a laterally extending span having diminished tensile strength compared with the remainder of the ring. When the cap is rotated in a loosening direction, the annular ring is constricted radially inwardly, thereby engaging the container neck and frustrating removal until either the bridge or span is broken. A broken bridge or span indicates tampering with the closure structure.

In a particularly preferred embodiment, the annular ring includes a web, a bridge connecting the web to the cap, a strip, and a span extending laterally between the web and the strip. The web and a first lateral end portion of the strip define, in combination, a notch having a distal opening facing the cap. When the closure is rotated in a loosening direction, the web is pivoted toward the first lateral end portion of the strip, thereby narrowing the opening in the notch and constricting the ring radially inwardly to abut the neck.

Abutment between the ring and the container neck precludes removal of the cap from the container until either the bridge or span is broken. Upon application of additional torque, either the bridge or the span is broken because of their diminished tensile strength compared with the remainder of the closure. Breakage of either the bridge or span also indicates that the closure has been tampered with.

In particularly preferred form, the cap and annular ring are integrally molded from plastic as a unitary structure. In addition, either the exterior surface of the container neck or an interior surface of the annular ring, or both, are given a roughened texture to enhance frictional engagement between the neck and ring.

DETAILED DESCRIPTION OF A PREFERRED EMBODIMENT

Figure 1:
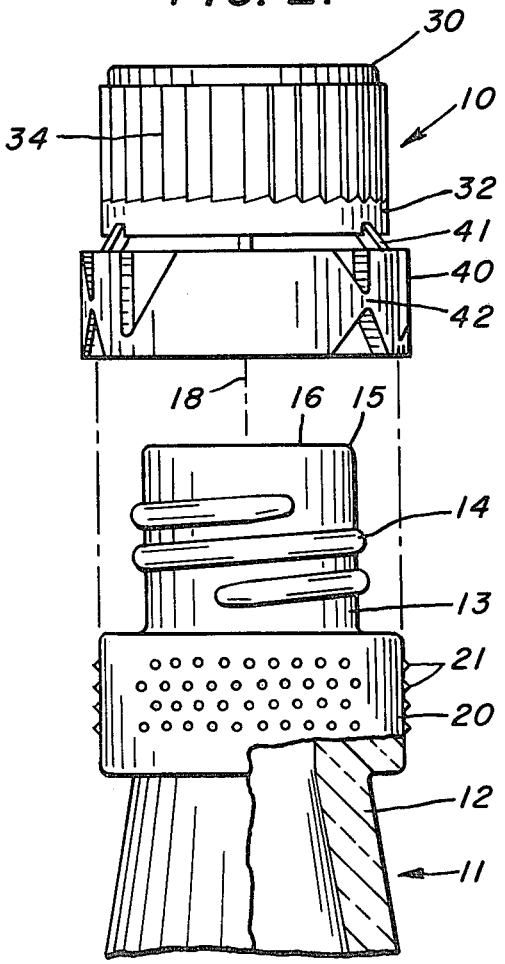
FIG. 1 is an exploded, elevational view of a tamper-evident resealable closure of the invention, together with a bottle of the type onto which the closure is fastened.
Figure 5:
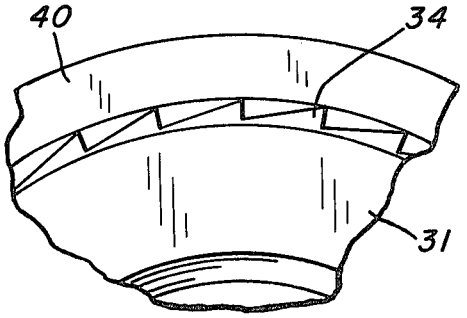
FIG. 5 is an enlarged, fragmentary, top elevational view of the closure of FIG. 2.

A preferred embodiment of the tamper-evident, resealable closure 10 of the invention is illustrated in FIG. 1 in relation to a container or glass bottle 11. The bottle 11 has a neck 12 formed distally with a finish portion 13. The finish portion 13 includes an external screw thread 14 and terminates in an annular rim 15 defining a mouth opening 16 of the bottle 11.

In the preferred embodiment shown in FIG. 1, the neck 12 includes a thick circular band 20. The band 20 extends around the circumference of the neck 12. A radially outwardly extending exterior surface of the band 20 is roughened by a multiplicity of small, generally conical bosses 21.

Figure 4:
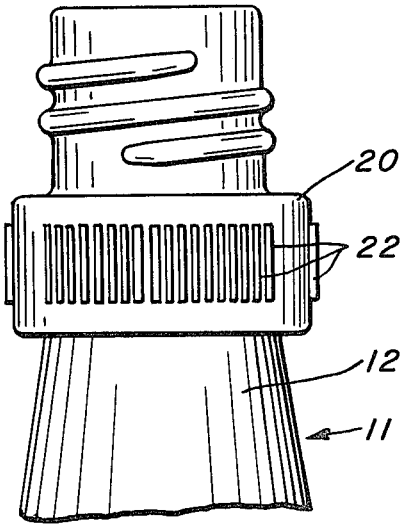
FIG. 4 is a front elevational view of an alternative bottle.

An alternative embodiment of the container 11 is shown in FIG. 4. In this embodiment, an exterior surface of the band 20 has several narrow, vertically extending projections 22.

Frictional engagement between the interior surface of the closure 10 and the neck 12 can also be enhanced by sandblasting the exterior surface of the neck 12. In yet another alternative embodiment (not illustrated), the neck 12 is formed with a grid pattern of radially indented grooves in a cross-hatched pattern, thereby roughening the exterior surface of the neck 12.

Figure 2:
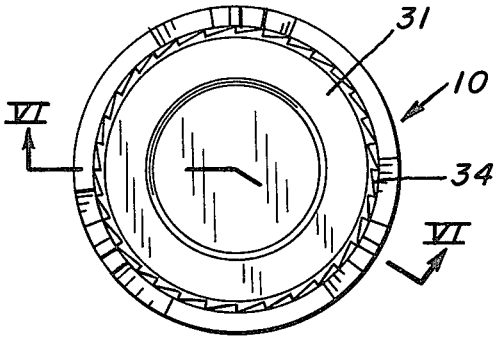
FIG. 2 is a top plan view of the closure of FIG. 1.
Figure 3:
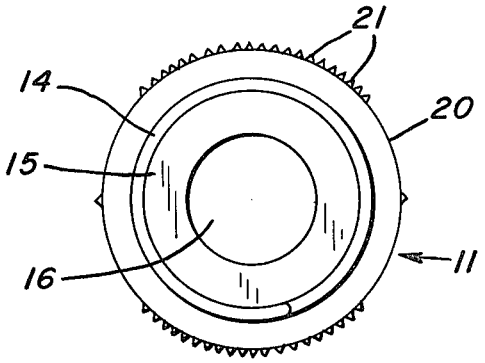
FIG. 3 is a top plan view of the bottle of FIG. 1.
Figure 6:
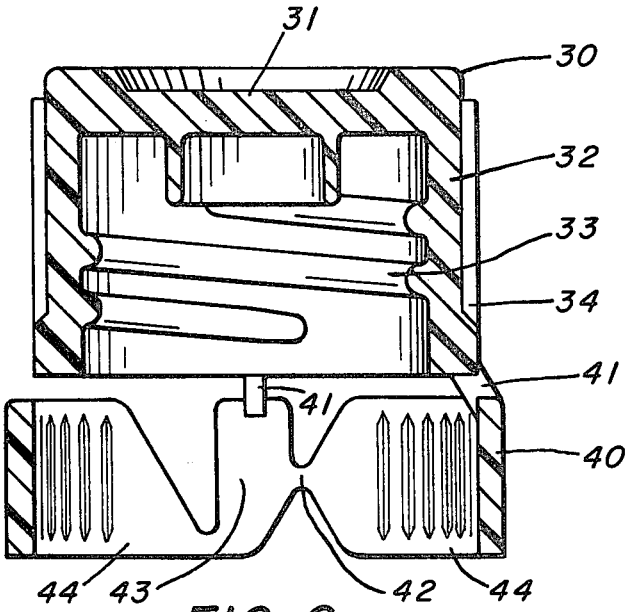
FIG. 6 is a cross-sectional view taken along the lines VI—VI of FIG. 2.

Referring now to FIGS. 1, 2 and 6, the resealable closure 10 includes a cap 30 having a generally planar top end wall 31 and a generally cylindrical skirt 32 extending generally downward from an outer perimetric portion or perimeter of the end wall 31. The skirt 32 is formed internally with an internal screw thread 33 mating with the external screw thread 14 on the container 11. An outwardly facing exterior surface of the skirt 32 includes several knurls 34 to facilitate manual gripping.

It is an important feature of the present invention that the closure 10 includes an annular ring 40 connected to the skirt 32 and extending downwardly or axially proximal thereto. When the closure 30 is fastened onto the bottle 11, the annular ring 40 is located contiguous to and radially outwardly of the neck 12. The ring 40 completely encircles the neck 12.

In the preferred embodiment described herein, the closure 10 is fastened onto the container 11 by application of torque to the cap in a first direction that is clockwise of a principal or vertical axis 18 (see FIG. 1). The closure 10 is removed by the application of torque to the cap in a second or counterclockwise direction. It is also within the scope of the present invention to provide a closure 10 and container 11 in which the directions of fastening and loosening are reversed.

The annular ring 40 is connected to the cap 30 by three vertically extending bridges 41. A feature of the annular ring 40 is that it includes three spans or weakened portions 42 extending laterally between and interconnecting portions of the ring 40. Each span 42 has diminished tensile strength compared with the remainder of the ring 40. In the preferred embodiment shown, the ring 40 is free to rotate circumferentially with respect to the neck 12 when torque is applied to the cap 30 in a clockwise or fastening direction. However, when torque is applied to the cap 30 in a counterclockwise or loosening direction, the ring 40 is compressed radially inwardly to engage the neck 12. Removal of the cap 30 is thereby frustrated until either a bridge 41 or a span 42 is broken.

In the preferred embodiment shown and described herein, the spans 42 are more susceptible to breakage upon counterclockwise rotation than are the bridges 41. By increasing the strength of the spans 42 in relation to the bridges 41, it is possible to construct the closure 10 so that the bridges 41 would be broken before the spans 42. Similarly, the closure 10 can be constructed so that either a bridge 41 or span 42 will break at approximately the same time when sufficient counterclockwise torque is applied. In any case, a broken bridge 41 or a broken span 42 will indicate both visually and by feel or touch that tampering with the closure has occurred.

The mechanism of operation of the tamper-evident closure 10 of the invention is best understood with reference to FIGS. 1 and 6–9. The ring 40 includes a web 43 joined vertically to the cap 30 by the bridge 41 and joined laterally to a laterally elongated strip 44 by the narrow span 42. The web 43 has a lower or proximal portion terminating at a lower or proximal edge 45, and an upper or distal portion terminating at an upper or distal edge 46. The upper edge 46 is spaced from and generally parallel to the proximal edge 45. The strip 44 comprises a first lateral end portion 47 having a distal or upper portion 48 spaced circumferentially of the web 43 and a proximal or lower portion 49 joined to the proximal portion of the web. The strip 44 and web 43 define, in combination, a generally V-shaped notch 50 having a distal or upper opening adjacent the skirt 32 of the cap 30.

The first lateral end portion 47 and web 43 are joined to one another by a hinge or hinge section 51 extending laterally between the lower portion 49 of the strip 44 and the lower portion of the web 43. In the particularly preferred embodiment illustrated, the hinge 51 is less likely to fracture than the span 42 when the closure 10 is rotated in a loosening direction. In an alternative construction of the closure 11 not shown in the drawings, the hinge 51 is narrower than the span 42 and, therefore, more likely to fracture than the span 42 when torque is applied to the cap 10 in a loosening direction. The terms "closure portion having diminished tensile strength" and "weakened portion" as used in the claims are intended to include both the span 42 and hinge 51, as well as other portions of the ring 40 which may conceivably be provided with diminished tensile strength.

The strip 44 further comprises a second lateral end portion 55 spaced circumferentially of the first lateral end portion, with the span 42 extending between the web 43 and the second lateral end portion 55 of the strip 44. In the preferred embodiment shown, the span is located intermediate the lower edge 45 and the upper edge 46 of the ring 40. The web 43 and the second lateral end portion 55 of the strip 44 define, in combination, a generally V-shaped slot 56 having a distal opening adjacent the skirt 32 of the cap 30.

Figure 9:
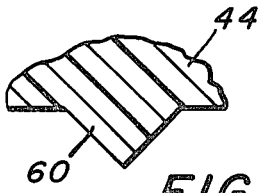
FIG. 9 is an enlarged, fragmentary, cross-sectional view taken along the lines IX—IX of FIG. 7.
Figure 8:
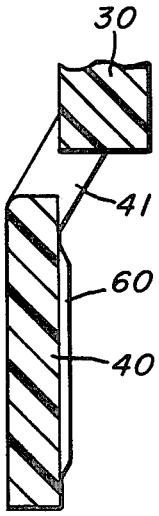
FIG. 8 is a cross-sectional view taken along the lines VIII—VIII of FIG. 7.
Figure 7:
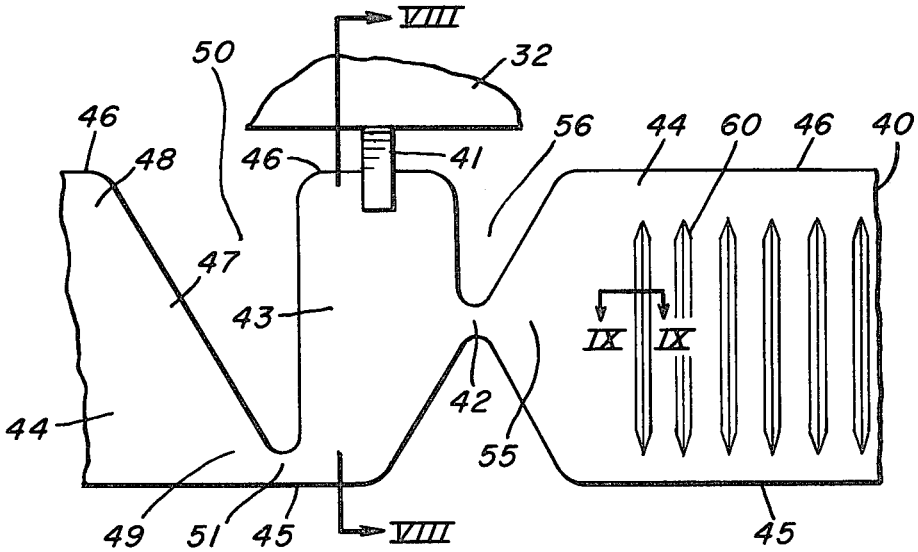
FIG. 7 is an enlarged, fragmentary elevational view of an internal portion of the annular ring shown in FIG. 6.

The ring 40 includes a radially inwardly facing interior surface formed with a plurality of vertically extending ridges 60 elevated radially inwardly of the interior surface, as shown in FIGS. 8 and 9. These ridges 60 are designed to enhance frictional contact between the ring 40 and the neck 12 of the container 11 when torque is applied to the cap 30 in a loosening direction. The exterior surface of the neck 12 may be provided with several narrow, vertically elongated projections 22 (shown in FIG. 4) extending in the direction of the vertical axis 18 at the same level as the ridges 60 for mechanical engagement with one another when loosening torque is applied. Mechanical engagement between the projections 22 and ridges 60 can be either matched, wherein circumferential spacings between ridges on the ring are equal to circumferential spacings between projections on the neck; or mismatched, wherein spacings between ridges on the ring and projections on the neck are unequal and out of phase with one another. The mismatched form of mechanical engagement is preferred because less movement or play is likely to occur between the ring and neck before locking up when loosening torque is applied to the closure 10.

When torque is applied to the cap 30 in a clockwise or fastening direction, the ring 40 is freely rotatable circumferentially around the neck 12. When the closure is rotated in this direction, the distal portion of the web 43 pivots toward the second end portion 55 of the strip 44, thereby widening the distal opening in the notch 50 and extending the ring 40 radially outwardly. This facilitates rotation of the cap 30 around the container 11.

When the closure 10 is rotated in counterclockwise direction for the purpose of loosening the cap 30 from the container 11, the distal portion of the web 43 is pivoted laterally toward the first lateral end portion 47 of the strip 44. The distal opening in the notch 50 is thereby narrowed, constricting the ring 40 radially inwardly to abut the neck 12 and precluding removal of the cap 30. However, as additional torque is applied to the cap 30, leverage is exerted on the span 42 connecting the web 43 and the second lateral end portion 55 of the strip 44. The web 43 acts as a lever having its proximal portion as a fulcrum. When the force applied exceeds the tensile strength of the span 42, the span 42 breaks, and the cap 30 becomes freely rotatable. A broken span 42 is readily observable both visually and by touch, thus indicating that the closure 10 has been tampered with.

In the particularly preferred embodiment described above, each of the components of the closure 10 is molded integrally from polyethylene. It is within the scope of the invention for the closure 10 to be constructed of other plastic materials such as polypropylene, or even metals such as aluminum.

As shown in FIG. 1, the particular closure 10 described herein has a ring 40 which includes three webs 43, three bridges 41, three strips 44 and three spans 42. A preferred construction of the ring 40 includes a plurality of webs 43, a bridge 41 connecting each of the webs 43 to the cap 30, a plurality of strips 44 and a span 42 connecting each of the webs 43 to each of the strips 44. As indicated in the claims, it is within the scope of the present invention to construct the ring 40 with only a single web 43, a single bridge 41 connecting the web 43 to the cap 30, a single strip 44 and a single span 42 connecting the web 43 to the strip 44. Closures having two, four, five and six or more webs, bridges, strips or spans are included within the scope of the invention.

It will be understood that the above description of the present invention is susceptible to numerous modifications and adaptations, and the same are intended to be included within the spirit and scope of the following claims.

What is claimed is:

1. A closure for a container having a neck comprising a distal finish portion terminating in an annular rim defining a mouth opening of the container, said closure comprising (a) a cap engaging the finish portion of the container, (b) an annular ring connected to the cap and located contiguous to and radially outwardly of the neck, said ring being free to rotate circumferentially with respect to the neck upon application of torque to the cap in a first direction corresponding to a fastening of the cap onto the container, and said ring being constricted radially inwardly to engage the neck upon application of torque to the cap in a second direction opposed to the first direction and corresponding to a loosening of the cap from the container, thereby frustrating removal of the cap from the container.

2. The closure of claim 1 wherein said annular ring comprises a weakened portion having diminished tensile strength compared with the remainder of the ring, said weakened portion being broken upon application of sufficient torque in the second direction to overcome the tensile strength of the weakened portion, thereby permitting manual removal of the cap from the container.

3. A tamper-evident closure for a container having a generally cylindrical neck comprising a distal, externally screw threaded finish portion terminating in an annular rim defining a mouth opening of the container, said closure comprising (a) a cap comprising a top end wall and a generally cylindrical skirt extending vertically from an outer perimetric portion of the end wall, said skirt having an internal screw thread mating with the external screw thread on the container, and (b) an annular ring encircling the neck of the container contiguous thereto, said ring being axially proximal of the cap and including (1) a web having a proximal portion and a distal portion, (2) a bridge connecting the web to the cap, (3) a strip comprising (A) a first lateral end portion having a distal portion spaced circumferentially of the web and a proximal portion joined to the proximal portion of the web, said strip and said web defining, in combination, a notch having a distal opening adjacent the cap, and (B) a second lateral end portion spaced circumferentially of the first lateral end portion, and (4) a span extending between the web and the second lateral end portion of the strip;

and wherein (1) said ring is freely rotatable circumferentially around the neck upon application of torque to the cap in a first direction corresponding to a fastening of the cap onto the container, and application of torque to the cap in a second direction corresponding to a loosening of the cap from the container pivots the distal portion of the web toward the first lateral end portion of the strip, thereby narrowing the distal opening in the notch and constricting said ring radially inwardly to abut the neck and precluding removal of the cap from the container, and (2) at least one of said bridge or said span is broken upon application of sufficient torque in the second direction to overcome the tensile strength of said bridge or said span, a broken bridge or a broken span indicating that the closure has been tampered with.

4. The closure of claim 3 wherein the neck of the container includes a radially outwardly facing exterior surface and the ring includes a radially inwardly facing interior surface opposed to and contiguous with said exterior surface, and wherein at least one of said exterior surface and said interior surface is roughened to enhance frictional contact therebetween upon application of torque to the cap in the second direction.

5. The closure of claim 3 wherein the ring includes a radially inwardly facing interior surface, and further comprising a vertically extending ridge elevated radially inwardly of the interior surface, said ridge enhancing contact between the ring and the neck of the container upon application of torque to the cap in the second direction.

6. The closure of claim 3 wherein the ring includes a proximal edge and a distal edge, the span extends laterally between the web and the strip intermediate said proximal edge and said distal edge, and the web constitutes a lever having its proximal portion as a fulcrum, said web thereby transmitting to the span torque applied to the cap in the second direction and promoting breakage of said span.

7. The closure of claim 3 wherein the ring includes a distal edge adjacent the cap and a proximal edge spaced from and generally parallel to the distal edge, the span extends laterally between the web and the second lateral end portion of the strip intermediate said proximal edge and said distal edge, and the second lateral end portion of the strip and the web define, in combination, a slot having a distal opening adjacent the cap; and wherein application of torque to the cap in the first direction pivots the distal portion of the web laterally of the first lateral end portion of the strip, thereby widening the distal opening in the notch and expanding said ring radially outwardly and facilitating rotation of the cap around the container.

8. The closure of claim 3 wherein said ring includes a plurality of webs, a bridge connecting each said webs to the cap, a plurality of strips, and a span connecting each said webs to each said strips.

9. The closure of claim 8 wherein said ring includes three webs, three bridges, three strips and three spans.

10. The closure of claim 3 wherein the first direction is clockwise of a principal axis of the closure, and the second direction is counterclockwise of said principal axis.

11. The closure of claim 3 wherein said cap and said ring are formed integrally as a unitary plastic molding.

* * * * *